US007392881B1

(12) United States Patent
Choate

(10) Patent No.: US 7,392,881 B1
(45) Date of Patent: Jul. 1, 2008

(54) MULTIPLE STAGE PERSONAL FALL ARREST ENERGY ABSORBER

(76) Inventor: Gary E. Choate, 4894 Van Gordon St., Wheatridge, CO (US) 80033

( * ) Notice: Subject to any disclaimer, the term of this patent is extended or adjusted under 35 U.S.C. 154(b) by 644 days.

(21) Appl. No.: 10/939,127

(22) Filed: Sep. 9, 2004

(51) Int. Cl.
*A62B 35/00* (2006.01)

(52) U.S. Cl. ..... 182/4; 182/3; 182/5; 280/805

(58) Field of Classification Search ..... 182/3, 182/4, 5, 18; 280/801.1, 805; 119/907
See application file for complete search history.

(56) References Cited

U.S. PATENT DOCUMENTS 3,444,957 A * 5/1969 Ervin, Jr. ..... 182/3
4,618,026 A * 10/1986 Olson ..... 182/4
5,529,343 A * 6/1996 Klink ..... 280/805
5,658,012 A * 8/1997 Villarreal et al. ..... 280/805

* cited by examiner

*Primary Examiner*—Alvin C. Chin-Shue
*Assistant Examiner*—Colleen M. Quinn
(74) *Attorney, Agent, or Firm*—Ramon L. Pizarro; Edwin H. Crabtree

(57) ABSTRACT

The use of a fall arrest lanyard that provides fall arrest forces at least two primary levels is disclosed. One example provides a lanyard with a pair of shock absorbers of different capacities in series. Other examples use a single shock absorber that provides at least two distinct levels of arrest force. Varying the strength of the attachment area that is to be separated to provide the arrest force and by varying the amount of area being separated at one time varies the levels of arrest force.

4 Claims, 7 Drawing Sheets

MULTIPLE STAGE PERSONAL FALL ARREST ENERGY ABSORBER

BACKGROUND OF THE INVENTION (a) Field of the Invention

This invention generally relates to a device or system for absorbing energy or decelerating an object, such as a falling person. More particularly, but not by way of limitation, to a strap having a connected area designed to tear by breaking the connective threads to create mechanical hysterisis under load and thereby absorb energy.

(b) Discussion of Known Art

The use of sewn sections of strap in order to provide a shock absorbing or energy absorbing member for lanyards is well known. See for example U.S. Pat. No. 3,444,957 to Ervin, Jr., incorporated herein by reference. A significant drawback to these devices is that they are often misused by individuals in the field. A common manner in which these devices are misused is by using a device that has been designed for a moderate fall in all situations. For example, a popular version of these shock absorbing lanyards are six-feet in overall length and are designed for providing an arrest force of 900 pounds of rip out or arrest force as the shock absorber separates during fall arrest. However, these shock absorbers are often used in situations where a fall that is longer than six feet is possible, such as where a person must stand or climb above the lanyard anchor point, or where the attachment to an anchorage point at their feet. Therefore this application requires a shock absorber that provides a high arrest force. The problem associated with using a shock absorber that provides too small of an arrest force for an extended fall (in this example, greater than six feet) is that the fall will cause the shock absorber to extend fully, until it has reached its full energy capacity and is fully extended. Once the lanyard is full length, with the shock absorber fully extended, the person attached to the lanyard is brought to an instantaneous, complete, stop. Such an abrupt stop can expose the worker to force spikes above acceptable levels and result in severe injury to the person relying on the lanyard for safety.

The U.S. Occupational Safety and Health Administration (OSHA) requires that fall protections systems, such as lanyards with shock absorbers, must be rigged and designed such that a falling worker will not fall more than six feet before beginning the deceleration process. Additionally, the deceleration process may not expose the falling worker to arrest forces greater than 1800 pounds, and the deceleration process may not take longer than 42 inches to decelerate the fall to rest.

Today's manufacturers produce two main types of shock absorbers. The first type, known as a Force level I shock absorber, is designed to arrest a six foot fall of a 220 pound person in 42 inches. The Force level I shock absorber provides a maximum arrest force of 900 pounds as it is torn out.

In many applications, there may not be a convenient overhead location where the six-foot long lanyard can be anchored to. For example, a six-foot tall ironworker may only have the steel beam at his feet from which to connect the lanyard. This will result in the exposure of the worker to a 12-foot free fall (the height of the worker plus the length of the lanyard, which is anchored near his feet). In this situation the use of the six-foot lanyard with the Force level I shock absorber is inadequate. As stated above, the Force level I shock absorber is designed to protect the worker in a six-foot fall, but in this example the worker has inadvertently anchored the lanyard in a manner that will result in a 12-foot fall. Accordingly, the Force level I shock absorber is not capable of absorbing all of the energy-gathered during this fall, and will use its entire capacity and suddenly stop stretching when the tear away stitch reaches it's end. This sudden stop will result in a massive jerk to the falling worker. As can be anticipated, a massive jerk is highly likely to injure the falling worker.

Instead of the 900 lb Force level I shock absorber, a shock absorber with a higher energy capacity is required in order to stop the longer fall within the required 42 inches. The next larger available shock absorber is a Force level II shock absorber, which provides a maximum arrest force of 1800 lbs, instead of the 900 lbs provided by the Force level I shock absorber. Thus, at first glance it appears that the solution to the problem of using too small of a shock absorber is to simply provide a higher arrest force shock absorber.

Unfortunately, the use of a Force level II shock absorber, with its 1800 lbs of deceleration force has significant disadvantages. One of the most significant disadvantages is that the 1800 lb deceleration force may itself injure the worker because it will create a greater than 10 G deceleration load on any worker that weighs less than 180 lbs. Arrest force greater than 10 g are not allowed by regulation.

The combined lanyard/shock absorber combination is typically provided together. The reason for providing these two items together is to ensure that the shock absorber is always matched to a lanyard that does not exceed six feet in length. However, as explained above, the length of lanyard does not guarantee that the worker will not be exposed to a larger than anticipated fall. Accordingly, there remains a need for a single fall arrest shock absorbing lanyard that may be used with short freefall distances (less than six feet) without exposing workers to large forces, and provide an added safety margin for situations where the worker anchors the lanyard to a location that will expose the worker to falls greater than six feet.

SUMMARY

It has been discovered that providing a dual phase shock absorber that absorbs energy in two distinct phases can solve the problems left unanswered by known art. It has been discovered that the use of a "dual phase" shock absorber, which can absorb energy at a first rate through a first section, and then absorb energy at a second, preferably higher rate, through a second section of the shock absorber is now possible due to the development of high efficiency energy tear webbing. According to a preferred example of the invention, the shock absorber tear webbing is a high efficiency shock absorber web that absorbs energy by first providing an arrest force of 900 pounds or less as the shock absorber separates for the first stage of deployment, and then at 1800 or less pounds as the shock absorber separates for the second stage of deployment. It is important to note that this example has been designed to meet both the Force level I and Force level II energy absorber specifications in a single device. However, it is contemplated that the energy absorption rate of each phase may be varied to suit the required specifications.

This energy absorber (also referred to as a shock absorber) has been designed for absorbing all of the fall energy of a 220-pound worker, whether in 6 ft or a 12-foot fall. The 12-foot fall criteria has been selected to address the fall distance that could be encountered when a six-foot tall worker anchors his six-foot long fall restraint lanyard at a location next to his feet or at a level that is near the level of his feet. A 6 ft (or less) fall would be encountered when a worker anchors his lanyard at an elevation that is equal to or above the attachment point on his personal harness (usually between the shoulder blades) According to a preferred example of the invention the shock absorber is formed from two straps, each having a leading end, a mid-portion, and a trailing portion. The two straps are conjoined to one another along an energy absorbing area and to a backup strap such that the pulling of the leading ends of the two straps away from one another first produces tearing from the leading ends towards the mid-portion, and then the tearing would progress simultaneously from the trailing end towards the mid-portion and from the leading end towards the mid-portion, so that in the second phase the shock absorber simultaneously tears along two locations. It has been discovered that this simultaneous tearing at two locations allows the manufacture of the shock absorber from a single strength of stitching or adhesion, and that the tearing or separation of the two straps along the two locations provides twice the energy absorption as when tearing along a single location or direction. Thus, the disclosed construction allows the creation of a shock absorber that provides 900 pounds of resistance as it first begins to tear, and then provides 1800 pounds of resistance when the shock absorber begins to tear along two locations, even though both sections of strap are joined to one another using a single-strength joint area.

According to a highly preferred example of the invention the shock absorber is made from a pair of crossed loops of strap material. A first loop is formed by attaching a first section of backup strap to the first strap at a location between the trailing portion and the leading end of the first strap. Then a second loop is formed by passing a second section of backup strap through the first loop and then attaching the backup strap to the second strap such that the second section of backup strap extends between the leading end and the trailing portion of the second strap. In this example, the first strap and the second strap are attached to one another along the area between the leading end and the trailing portion. This attachment area, attaching the first strap to the second strap, is what is used to absorb the energy of the fall. Once the attachment area is separated while absorbing the energy of a fall, the first strap and second strap cross each other while remaining attached to the backup strap.

The lanyard and connectors that are used to attach the shock absorber to the harness that is worn by the worker are attached to the leading ends of the first and second straps. Accordingly, once the shock absorber is used, and the energy absorbing attachment area is separated, both of the loops will remain crossed over one another and attached to the backup strap. This crossed attachment to the backup strap keeps the two sides of the web from separating completely if they are ripped out to their full length and provides redundant load paths that will support the worker in the event that any of the individual other straps fail, making the disclosed invention particularly robust and safe.

According to another example of the energy absorber includes:

a first section of strap, the first section of strap having a lower surface having a leading end, a mid-portion, and trailing portion;

a second section of strap, the second section of strap having an upper surface having a leading end, a mid-portion, and trailing portion, the leading end of the upper surface of the second strap being attached to the leading end of the lower portion of the first section of strap with a connection of a first tear strength, the mid-portion of the upper surface of the second section of strap being attached to the mid-portion of the lower surface of the first section of strap with a connection of a second tear strength.

It is further contemplated that the shock absorber will provide a deceleration force by the tearing away of the connection between the first strap and the second strap. Preferably, the connection between first strap and the second strap is accomplished by stitching or weaving the two straps together. The area of higher strength, or the differences in strength, may be achieved by varying the density of stitching or woven threads that joins the two straps. Thus, the first stage area of lower strength would have lower stitch or thread density, while the second stage area of higher strength would be of a higher density of stitching or threads. Of course, changing the strength of the thread used to join the two straps together may also vary the strength of the conjoining parts. However, it is contemplated that merely varying the density of the stitching, or threads to achieve a variation in joint strength eliminates the need to change the thread during manufacture, and thus making it easier to manufacture.

It is also contemplated that the two straps may be joined by sections of adhesive. When using adhesives, it is contemplated that the differences in adhesion or connection strength may be achieved by using adhesives having different mechanical properties, or by connecting the straps with different sized areas of adhesive. Thus it is contemplated that a small area of adhesive may provide a low strength connection area, while a large strength a large area of adhesive would form a high strength area.

In operation, one of the two straps is attached (usually through a section of lanyard) to the anchoring or support structure, while the other section of strap is attached to the worker. Thus once the lanyard is pulled away from the anchoring point, the two straps are pulled apart from one another. As the attached sections of strap are pulled apart from one another while the shock absorber is deployed, the area of lower strength will be separated first, and then immediately progress to the higher strength area. Thus, according to a highly preferred example of the invention the connection of a first strength will provide 900 lb of resistance, as the sections are pulled apart and rip to a distance that will absorb all the energy of a 6 ft free fall, then the connection of a second strength will provide 1800 lbs. of resistance continue to rip at the higher force until all the energy from the 6 ft. to the 12 ft. drop distance is absorbed thus absorbing all of the input energy.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
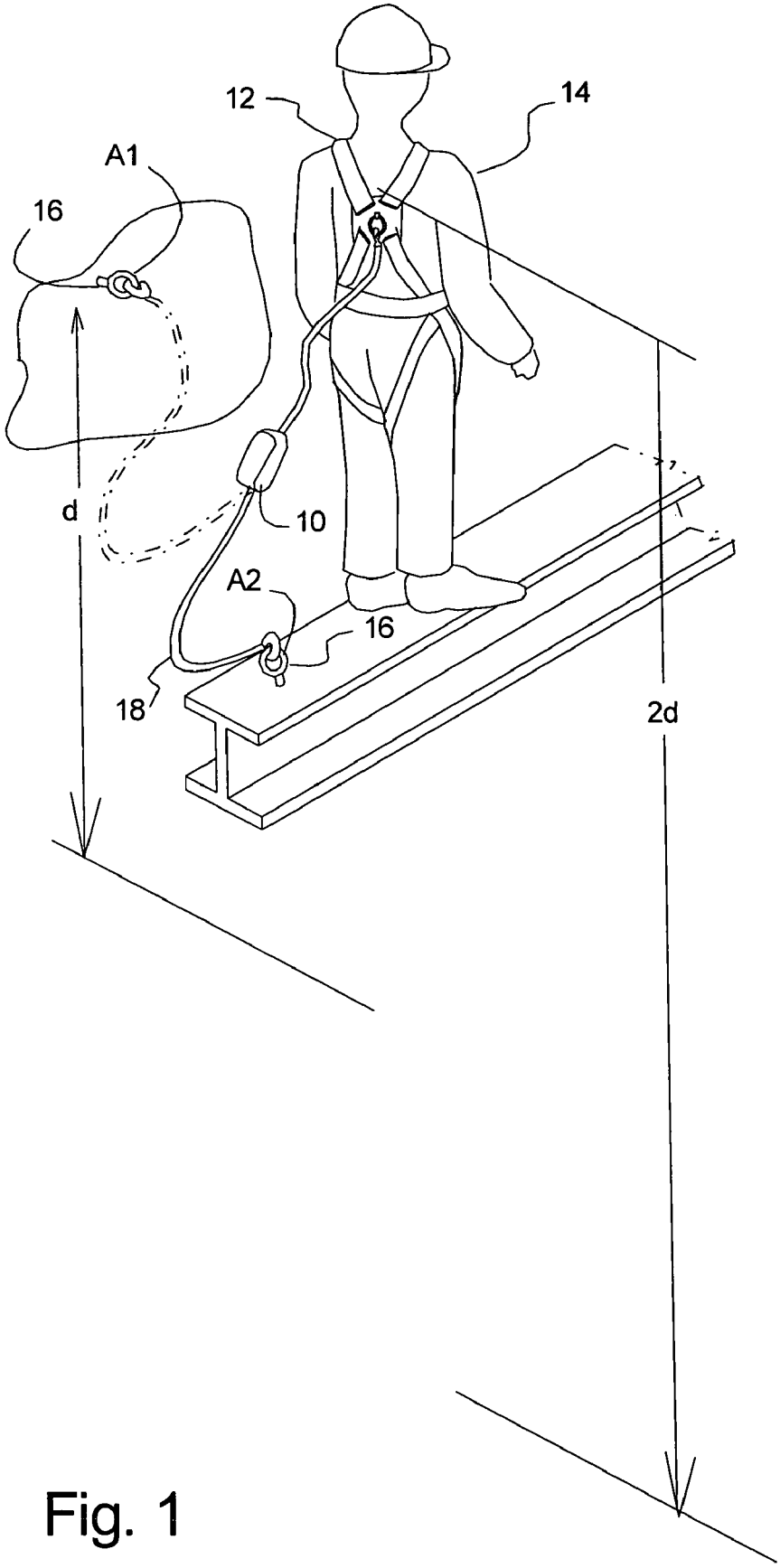
FIG. 1 illustrates use of the shock absorber in conjunction with a safety harness while in use by a worker.

Turning now to FIG. 1 where a shock absorber 10 has been illustrated while in use with a safety harness 12 worn by a six-foot tall worker 14. The worker 14 is shown standing on a surface that includes an anchoring point 16 that is at the level of the worker's feet. The anchoring point has been illustrated as being a rigid anchor ring, but may be any anchoring structure or device, examples include structure of the building itself or devices such as clamps, lifelines, and other safety equipment. The shock absorber has been illustrated in use with a lanyard 18 that is attached to the anchoring point 16 while the shock absorber 10 has been positioned in series along the lanyard 18 close to the harness 12.

As discussed above, the anchoring of the lanyard 18 at a location near the worker's feet exposes the worker to a fall that is larger than expected. It is frequently expected that a worker using a six foot lanyard will only fall about six feet. This expectation is reasonable if the worker anchors himself at a location that is equal in height to his harness dorsal d-ring such as anchoring point A1 shown on FIG. 1. However, by anchoring the lanyard near the worker's feet, at anchoring point A2, the lanyard is extended upwards, exposing the worker 12 to a fall of nearly 12 feet. Thus, by anchoring at A1 the worker is exposed to a fall distance of "d", but using the same lanyard and anchoring at A2 the worker is exposed to twice the fall distance indicated as a distance of "2d". The added fall distance allows the falling worker to gather more momentum than initially anticipated, and therefore requires a greater arrest-force to stop the fall. Accordingly, the shock absorber used with a six-foot lanyard must be capable of providing a large arrest force that is capable of absorbing the energy of a fall that is significantly longer than six feet. However, it is also important that the shock absorber provide an arrest force that is smaller in the event that the worker anchors the lanyard from the appropriate location and experiences a short fall. It is important not to use more arrest force than required by the fall. This is because the arrest force may itself cause injury to the worker, by creating large de-acceleration forces and the larger the arrest force that is used, the greater the chance of injuring the worker.

In order to solve the problems associated with known shock absorbers, a dual phase shock absorber 20 is disclosed for use with the lanyard 18. The dual phase shock absorber 20 provides at least two levels of resistance (arrest force). One level of resistance or arrest force is of a first magnitude that is appropriate for the arrest of a short fall (within 6 ft), and a second level of resistance or arrest force is of a second magnitude that is appropriate for a longer fall (within 12 ft). In the examples discussed here the arrest force of a first magnitude is 900 pounds or less, which is the arrest force required by OSHA for a six-foot fall by a 220 pound worker, and the arrest force of the second magnitude is 1800 pounds or less, which is the arrest force required by OSHA for the arrest of a 12 foot fall of a 220 pound worker.

Figure 2:
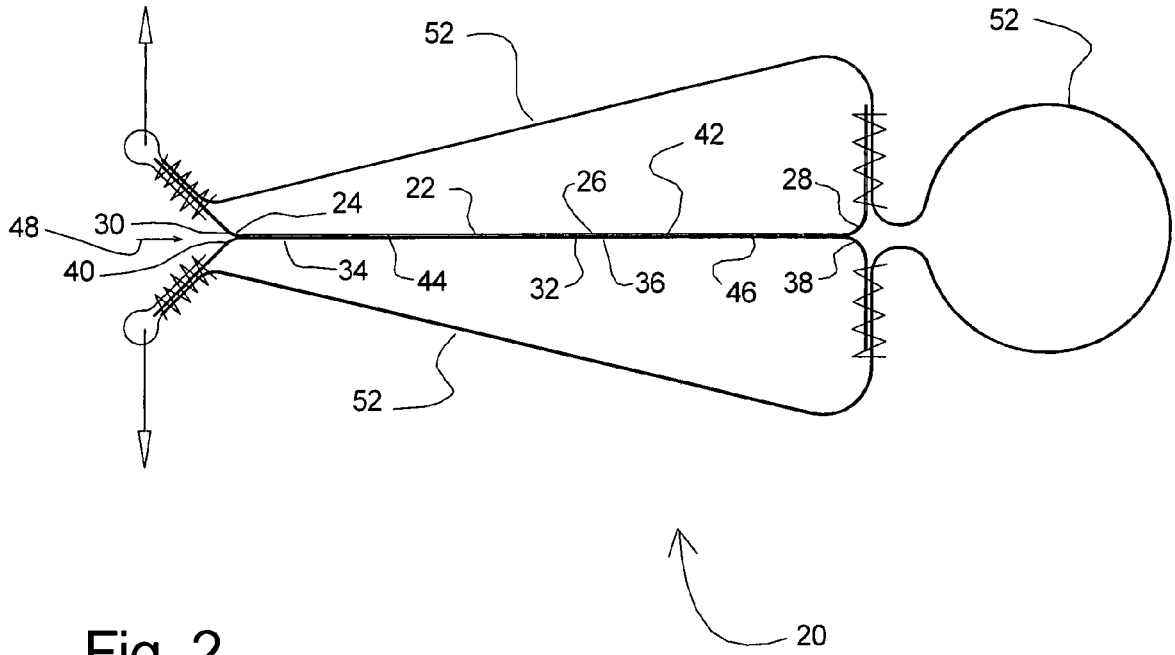
FIG. 2 illustrates an example of the shock absorber and the joining of the straps with a backup strap of unitary one piece construction.

Turning to FIG. 2 it will be understood that an example of the dual phase shock absorber 20 includes a first strap 22 that includes a leading end 24, a mid-portion 26, and trailing portion 28. Additionally, the first strap 22 includes a lower surface 30. The first strap 22 is attached to a second strap 32 that includes a leading end 34, a mid-portion 36, and trailing portion 38. Additionally, the second strap 32 includes an upper surface 40 that is attached to the lower surface 30 of the first strap 22 through an attachment area 42 that extends along the lower surface 30 of the first strap 22 and upper surface 40 of the second strap 32.

It is contemplated that the attachment area 44 will consist of a leading attachment area 44 and a trailing attachment area 46. The leading attachment area 44 lies between the leading end 34 of the first strap 22 and the leading end 34 of the second strap 32. The trailing attachment area 46 is positioned between the leading attachment area 44 and between the trailing portion 28 of the first strap 22 and the trailing portion 38 of the second strap 32. It is contemplated that the leading attachment area 44 will be of a first peel strength and that the trailing attachment area 46 will be of a second peel strength. According to one example the first peel strength is lower than the second peel strength. With this arrangement the shock absorber will provide two levels of resistance to the fall. As the leading end 22 of the first strap 22 is pulled away from the leading end 34 of the second strap 32 the area of the first peel strength will separate and the shock absorber 20 will provide an arrest force of a first magnitude, and as the area of the second peel strength separates the shock absorber 20 an arrest force of a second magnitude. According to a preferred example of the invention the first magnitude is about 900 pounds, and the arrest force of a second magnitude is about 1800 pounds.

According to one disclosed example disclosed herein, the attachment area 42 is formed through stitching the first strap onto the second strap. Accordingly, increasing the density of the stitching may vary the peel strength of the attachment area 42. Additionally varying the type of stitching used can also be used to vary the peel strength of the attachment area 42 as well as varying the strength of the material used for the stitching. Still further, it is contemplated that the attachment area may be formed trough weaving together sections of strap, gluing these sections of strap, or by providing other mechanical or chemical adhesion of the two straps.

Also illustrated in FIG. 2 is that it is contemplated that the dual phase shock absorber 20 will include at least one backup strap 52 that keeps the first strap 22 attached to the second strap 32 after the attachment area 42 has been severed.

Figure 3:
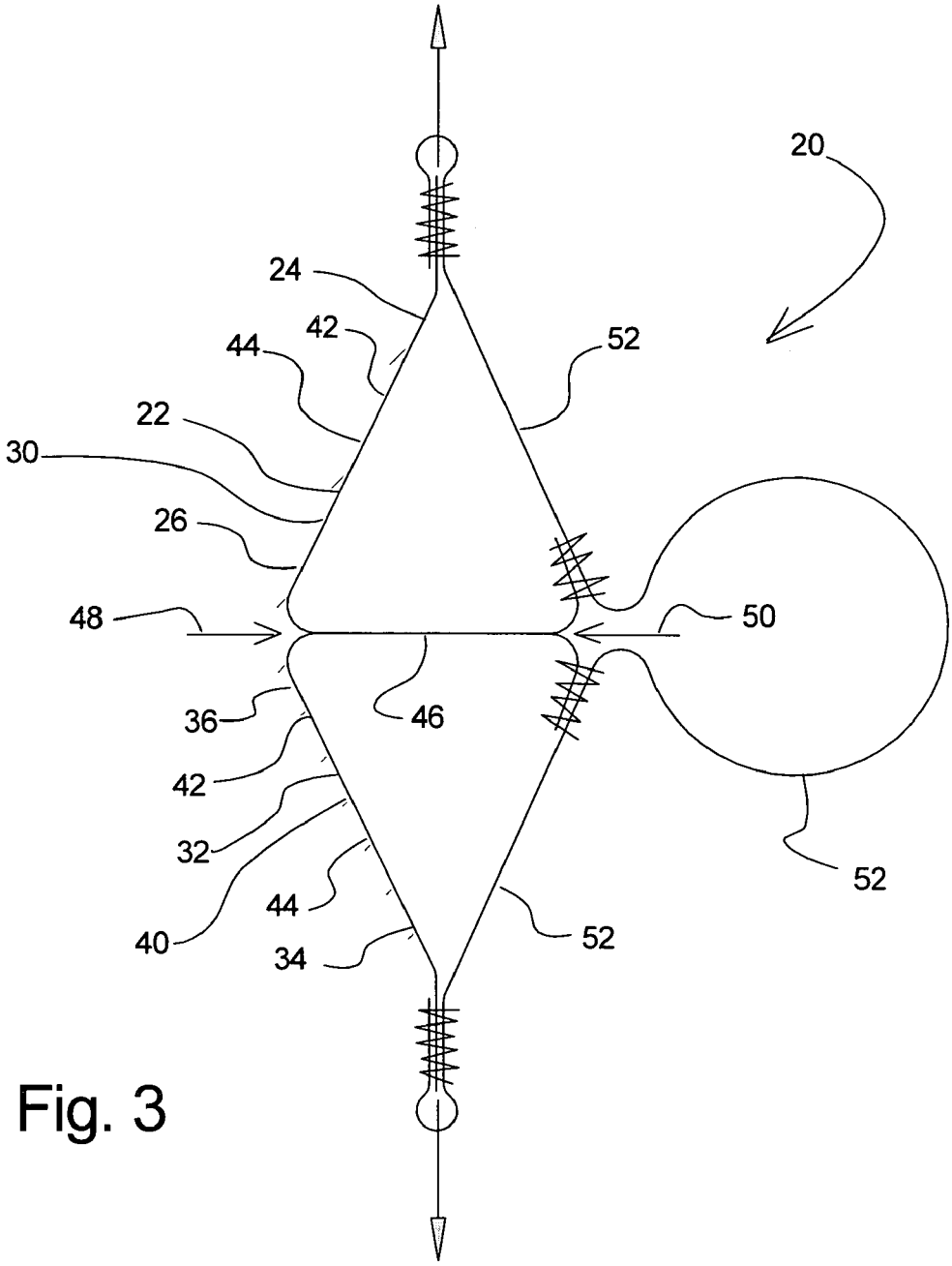
FIG. 3 illustrates the tearing of the shock absorber along the lower strength area (say, 900 pound per inch tear-out).
Figure 4:
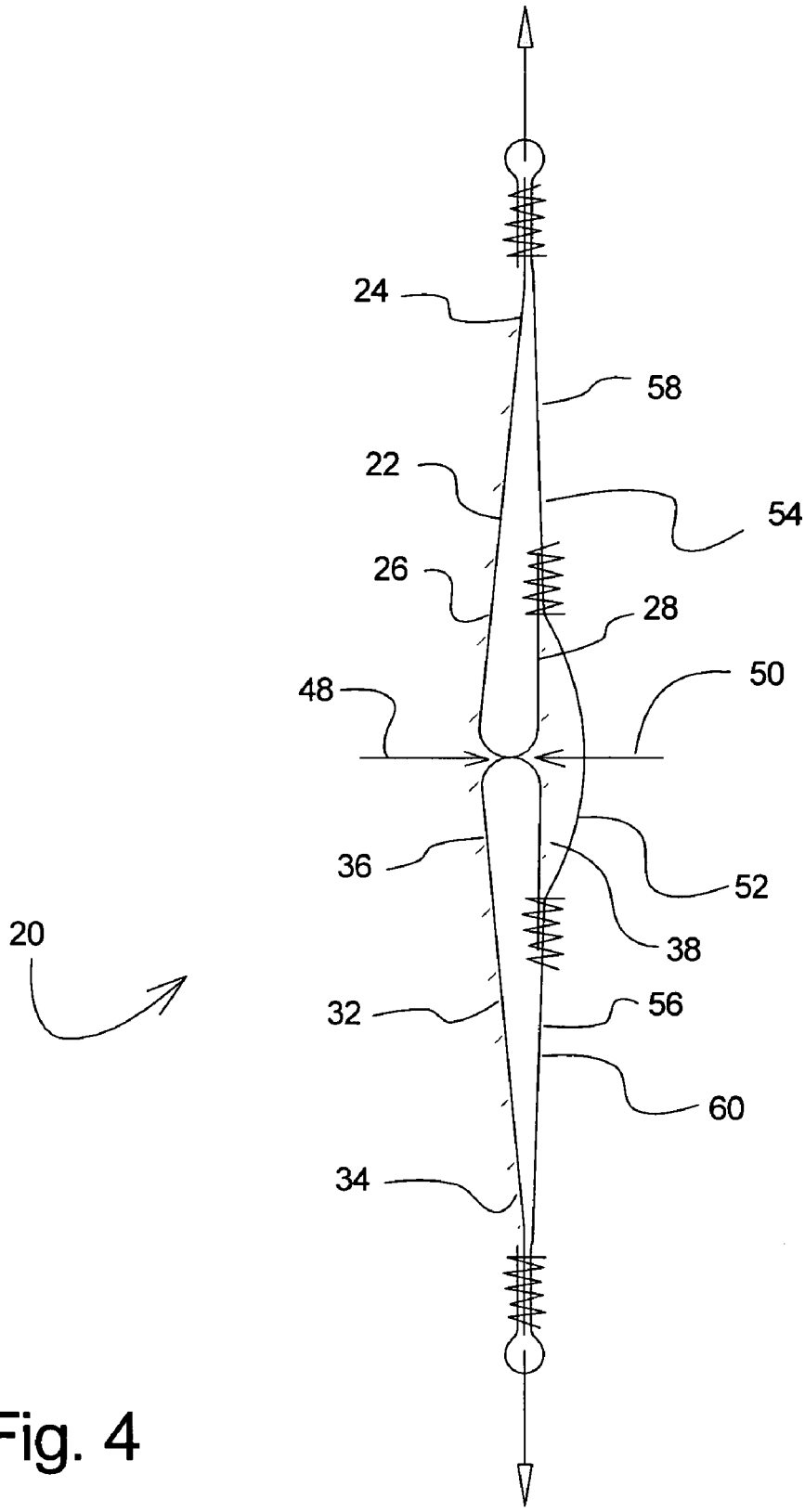
FIG. 4 illustrates the tearing of the shock absorber along the high strength area (say, 1800 pound per inch tear-out).

In the example of the dual phase shock absorber illustrated in FIGS. 2-4 the second peel strength is substantially equal to the first peel strength and the arrest force of a second magnitude is greater than the arrest force of a first magnitude, the arrest force of a first magnitude. The increased arrest force delivered by the dual phase shock absorber 20 is created by tearing of the attachment area 42 from the leading end of the first strap towards the trailing portion of the first strap, and the arrest force of second magnitude being created by simultaneously tearing the attachment from the leading end of the first strap towards the trailing portion of the first strap, illustrated by arrow 48, and from the trailing portion 28 of the first strap 22 towards the leading end 24 of the first strap 22, illustrated by arrow 50.

As illustrated in FIGS. 2 through 5, the first strap 22 and the second strap 32 are also attached to at least one backup strap 52. Preferably, the backup strap 52 is used to prevent the first strap 22 and the second strap 32 from separating from one another and to provide a parallel load path to the first strap 22 and the second strap 32. In order to ensure that a parallel load path is formed, the crossed over loop arrangement discussed below is used. This crossed over loop arrangement results in the arrangement illustrated in FIG. 5 once the first strap 22 and the second strap 32 are separated from one another.

Figure 5:
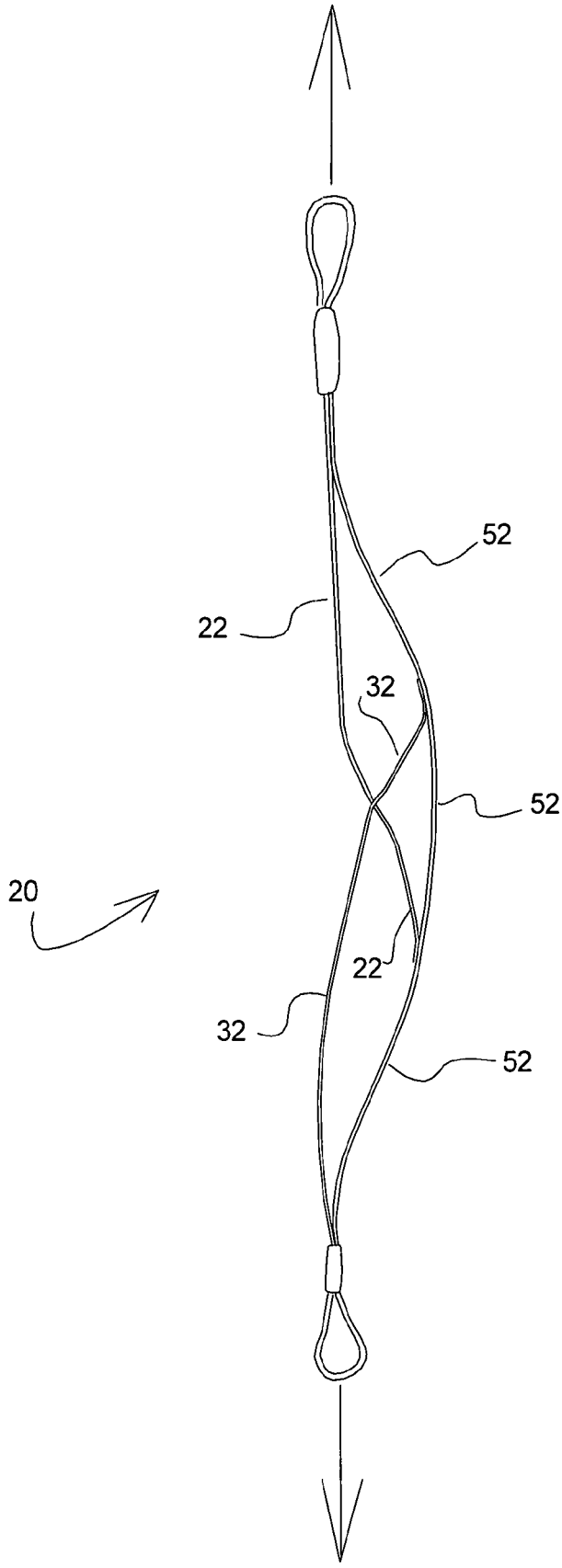
FIG. 5 illustrates the crossed first loop and second loop after the first strap and the second strap have separated.

FIG. 5 illustrates that the crossed over loop arrangement is formed by creating a first loop 54 by attaching the trailing portion 28 of the first strap 22 to the backup strap 52. Then creating a second loop 56 by attaching the trailing portion 38 of the second strap 32 to the leading end of the backup strap, forming the second loop 56. This crossed over loop arrangement creates the parallel load paths that provide additional safety to the disclosed invention once the first strap 22 and the second strap 32 have separated.

According to yet another example the first loop includes a first backup strap 58 between the trailing portion 28 and the leading end 24 of the first strap, and a second backup strap 60 between the trailing portion 38 of the second strap 32 and the leading end 34 of the second strap 32, and the two loops are crossed over, and thus linked to one another.

It is important to note that it is contemplated that the crossed loop arrangement will be used as part of the dual phase shock absorber 20 arrangements disclosed here. Thus according to a preferred example of the invention, in addition to the crossed loop arrangement it is contemplated that the energy absorption portion will be formed by attaching the lower surface 30 of the first strap 22 to the upper surface 40 of the second strap 32 through an attachment area 42 that is asymmetrically positioned along the first loop 52 and the second loop 56, so that upon pulling the leading end 24 of the first strap 22 away from the leading end 34 of the second strap 32 will first causes tearing of the attachment area 42 from the leading end 24 of the first strap 22 towards the trailing portion 28 of the first strap 22, as indicated by arrow 48, and then the attachment area 42 will tears simultaneously in from the direction indicated by arrow 48 and from the trailing portion 38 of the first strap 22 towards the leading end 24 of the first strap 22 as indicated by arrow 50. Thus the attachment area 42 will first tear in one direction, providing one level of arrest force, and then after a predetermined length from both directions, providing a higher level of arrest force.

Figure 6B:
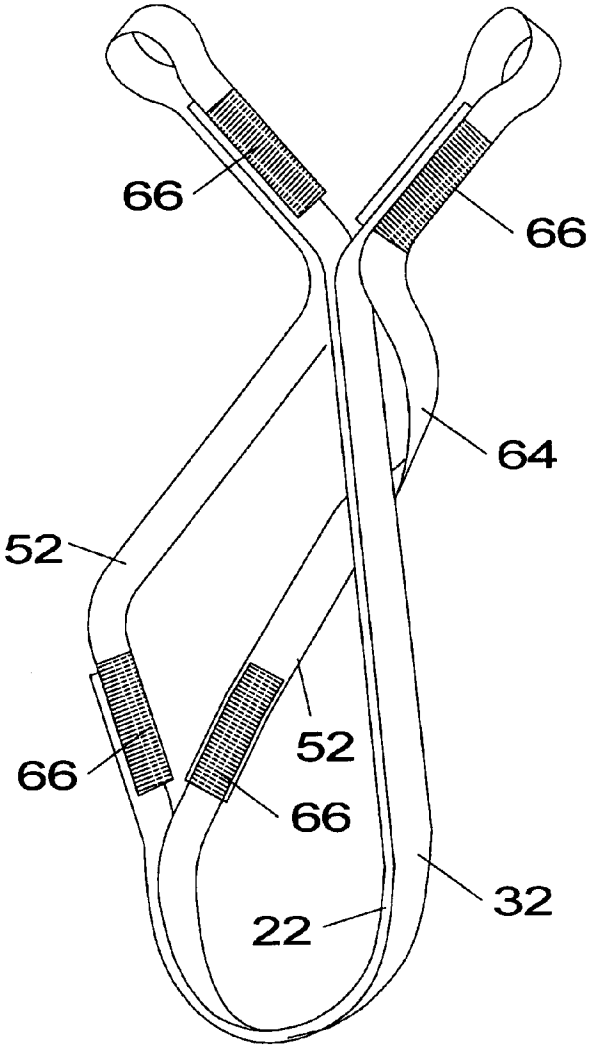
FIG. 6B illustrates an example of the crossed first loop and second loop before the first strap and second strap have separated and show "B" without a back up strap.
Figure 6A:
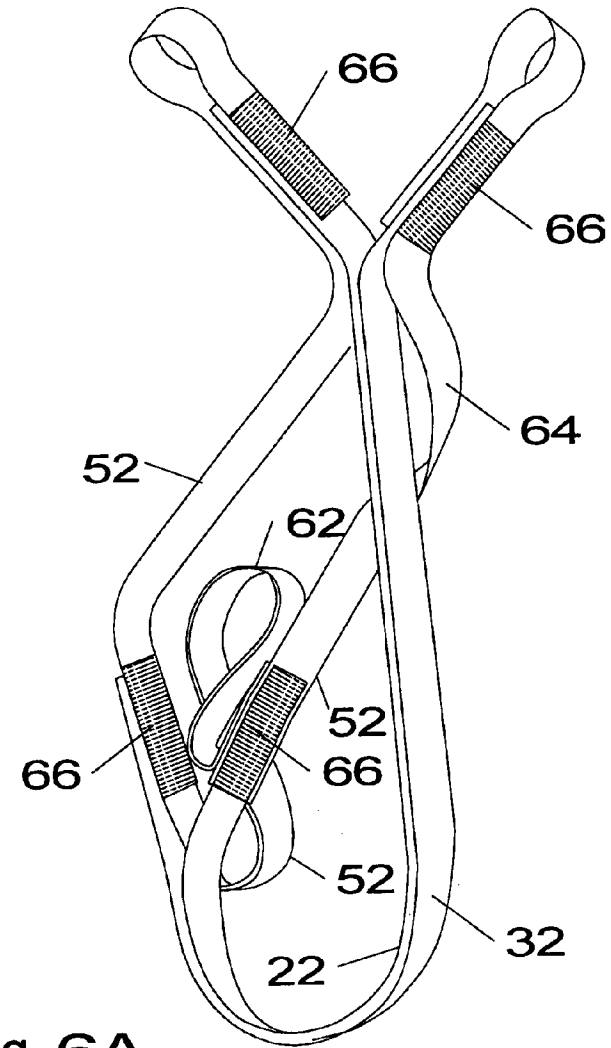
FIG. 6A illustrates an example of the crossed first loop and second loop before the first strap and second strap have separated and show "A" with a back-up strap.

Turning to FIG. 6 it will be understood that it is also important to note that it is contemplated that a safety lanyard with dual phase shock absorbing capabilities may also be fabricated with or without a back up strap loop 62 by attaching the webbing together at stitch location 66. As shown in FIG. 6B. Due to the twist 64 in the back up strap webbing 52 the 2 sides of the tear webbing 22 & 32 cannot become completely separated after rip out has extended to their fall length, whether the shock absorber is made with or without the back up strap loop 62. The length of back up strap loop 62 can be used to adjust the max extension allowable of the shock absorber.

Figure 7A:
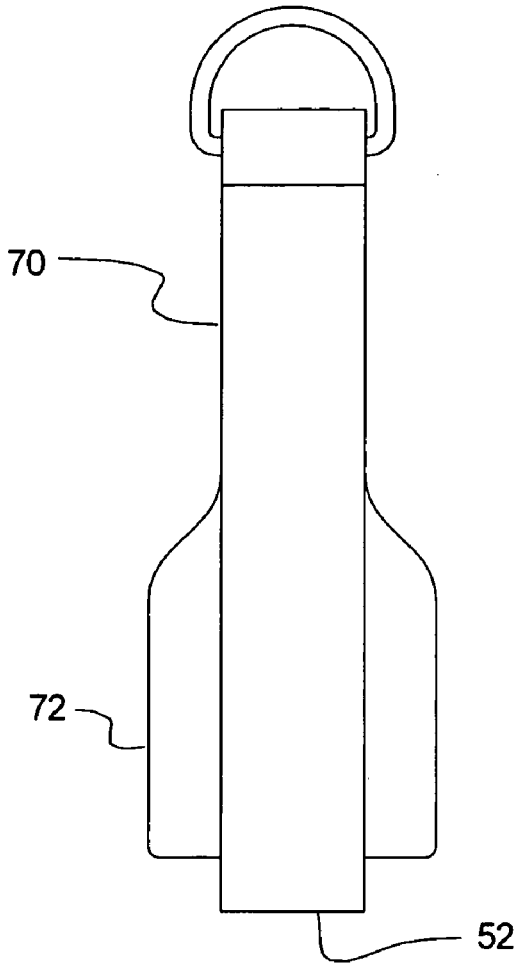
FIG. 7A illustrates yet another example of a dual phase shock absorber.
Figure 7B:
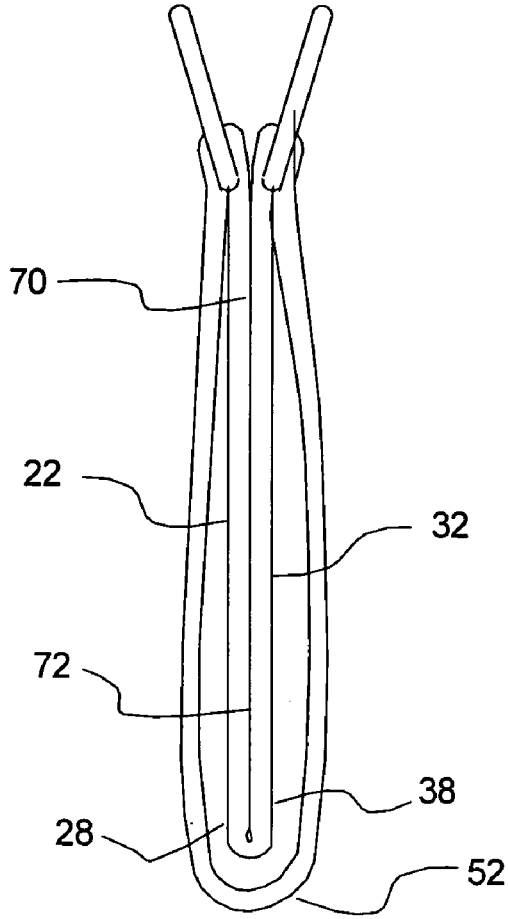
FIG. 7B is a side view of the example shown in FIG. 7A.

FIGS. 7A and 7B illustrate another example of a dual phase shock absorber, where the areas of different arrest force are created by different sized attachment areas, with one low resistance attachment area 70 and a high resistance attachment area 72. The difference in the arrest forces is provided by the size of the attachment area being separated. The example also uses a backup strap 52. However it is important to note that the example illustrated in FIGS. 7A and 7B the first strap 22 and the second strap 34 may be formed from a single section of material that has been double over or from two separate sections that are attached (for example sewn) together at the trailing portion 28 and 38 of the first strap 22 and second strap 32 respectively. Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A dual phase shock absorber for use with a lanyard, the dual phase shock absorber providing at least two levels of resistance, the shock absorber including:

a backup strap;

a first loop comprising a first strap and the backup strap, the first strap having a lower surface and a leading end, a mid-portion, and trailing portion, the leading end of the first strap and the trailing portion of the first strap being connected to the backup strap to form the first loop;

a second loop comprising a second strap and the backup strap, the second strap having an upper surface and a leading end, a mid-portion, and trailing portion, the trailing end of the second strap extending through the first loop while the leading end and the trailing portion of the second strap are connected to the backup strap to form the second loop, and the lower surface of the first strap being attached to the upper surface of the second strap through an attachment area that extends along the lower surface of the first strap and upper surface of the second strap, the attachment area extending between the leading end of the first strap and the leading end of the second strap towards the mid-portion of the first strap and the mid-portion of the second strap such that the adhesion area between the first loop and the second loop is asymmetrically positioned along the first loop and the second loop, so that upon pulling the leading end of the first strap away from the leading end of the second strap first causes tearing of the attachment area from the leading end of the first strap towards the trailing portion of the first strap and then the attachment area tears simultaneously in a direction from the leading end of the first strap towards the trailing portion of the first strap and from the trailing portion of the first strap towards the leading end of the first strap.

2. A dual phase shock absorber according to claim 1 wherein said first loop and said second loop are crossed over one another.

3. A dual phase shock absorber according to claim 1 wherein pulling the leading end of the first strap away from the leading end of the second strap cause tearing of the attachment area from the leading end of the first strap towards the trailing portion of the first strap to create an arrest force of a first magnitude, and then the attachment area then tears simultaneously in a direction from the leading end of the first strap towards the trailing portion of the first strap and from the trailing portion of the first strap towards the leading end of the first strap to create an arrest force of a second magnitude, the arrest force of a second magnitude being larger than the arrest force of a first magnitude.

4. A dual phase shock absorber according to claim 3 wherein said arrest force of a first magnitude is about 900 pounds, and said arrest force of a second magnitude is about 1800 pounds.

* * * * *